United States Patent [19]

Tsuji et al.

[11] Patent Number: 5,001,446

[45] Date of Patent: Mar. 19, 1991

[54] SHAPE MEMORY ALLOY AND ELECTRIC PATH PROTECTIVE DEVICE UTILIZING THE ALLOY

[75] Inventors: Koji Tsuji; Yoshinobu Takegawa, both of Nara, Japan

[73] Assignee: Matsushita Electric Works, Ltd., Japan

[21] Appl. No.: 383,096

[22] Filed: Jul. 21, 1989

[30] Foreign Application Priority Data

Aug. 1, 1988 [JP] Japan ..... 63-192569
May 29, 1989 [JP] Japan ..... 1-135283

[51] Int. Cl.[5] ..... H01H 71/18

[52] U.S. Cl. ..... 335/43; 148/11.5 R; 148/402; 148/442; 337/140

[58] Field of Search ..... 148/402, 11.5 R, 11.5 N, 148/426, 442; 335/6, 7, 18, 43; 337/140

[56] References Cited

U.S. PATENT DOCUMENTS 4,205,293 5/1980 Melton et al. ..... 337/140

FOREIGN PATENT DOCUMENTS 60-221922 6/1985 Japan .

*Primary Examiner*—R. Dean
*Attorney, Agent, or Firm*—Leydig, Voit & Mayer

[57] ABSTRACT

A shape memory alloy consists of a three element alloy of nickel-titanium-copper which is formed as being subjected to a cold working and to a heat treatment at a temperature below recrystallization point of the alloy for storing the shape, the alloy being thereby improved in operation stability and reliability even after repetitive operation and made wider in environmental temperature range for use therein of the alloy.

13 Claims, 9 Drawing Sheets

SHAPE MEMORY ALLOY AND ELECTRIC PATH PROTECTIVE DEVICE UTILIZING THE ALLOY

TECHNICAL BACKGROUND OF THE INVENTION

This invention relates to a shape memory alloy and an electric path protective device which detects an excessive current flowing through an associated electric path and generates an output responsive thereto.

An electric path protective device utilizing a shape memory alloy is useful in electric path breaking mechanism, in particular, circuit breakers or protectors.

DISCLOSURE OF PRIOR ART

In protecting a load from such excessive current as an overcurrent, short-circuit current or the like, in general, there has been employed the circuit breaker as the electric path protective device, and the circuit breaker incorporates therein an element for detecting any excessive current. A typical detecting element is a bimetal, which comprises two metal strips respectively of smaller and larger thermal expansion coefficients and joined together so that heat generated due to, for example, an overcurrent flowing through the bimetal would cause it to bend onto the side of the metal of the smaller thermal expansion coefficient so as to actuate a circuit opening system. It has been required, however, to dispose two of the bimetals of different set current separately from each other so that the breaker employing the bimetal can be responsive to both the overcurrent and short-circuit current. This results in an increased number of components rendering the structure complicated.

There has been disclosed in U.S. Pat. No. 4,205,293 to K. N. Melton et al a thermoelectric type switch having a detection element made of a shape memory alloy of nickel, titanium and copper, which is directly connected to a main circuit for allowing a main circuit current to pass therethrough and opening the circuit in response to the overcurrent. This switch of Melton et al is, however, of a type in which the element is directly heated to be capable of responding to the overcurrent but is not arranged for responding to the short-circuit current. Further, the shape memory alloy employed in the switch of Melton et al is to be utilized in its martensite phase transformation so as to have bi-directional shape memory function utilized, in which event of utilizing the martensite phase transformation there arises a drawback that, while a larger load can be generated, reliability after the repetitive operation becomes poor. Further, in Japanese Pat. Application Laid-Open Publication No. 60-221922 of H. Kondo et al and others, such overcurrent detecting device comprising a shape memory alloy that can expand and contract at its transformation temperature so as to carry out the circuit opening with the overcurrent or short-circuit current detected has been disclosed. In the electric path protective devices using a detecting element of the shape memory alloy, it appears possible to cause the device to be responsive to both overcurrent and short-circuit current with a single detecting element.

Since, in this case, a continuous flow of the overcurrent or short-circuit current through the detecting element of the shape memory alloy employed in the circuit breaker should result directly in a fire trouble in the construction or the like, it is essential that operational characteristics of the alloy are highly reliable, while taking well into account the fluctuation in the operational temperature, the extent of the fluctuation in environmental temperature, phase transformation temperature and so on. In adapting the highly reliable shape memory alloy to practical use as the detecting element, here, it is important to constantly attain the phase transformation, in particular, of the alloy.

For the shape memory alloys practically utilized, there may be enumerated, as roughly classified, nickel-titanium series and copper series (CuZn, CuZnAl and so on) alloys, in which the nickel-titanium series alloys are more excellent in the reliability and corrosion resistivity than the copper series alloys and high in the adaptability to the use in the electric path protective device the reliability in particular is demanded. For the phase transformation which is contributive to the change of shape of the nickel-titanium alloy, there are a martensite phase transformation and R phase transformation. Here, the martensite phase transformation allows to attain a larger distortion and, accordingly, a generated load is also large, but is poor in the reliability in respect of the repetitive operation. In the case of the generated load, for example, it happens that the generated load is lowered by 5% when first time and second time operations are compared, and the transformation temperature is also caused to fluctuate by repetitive operations so as to eventually cause the operation temperature itself to fluctuate. In the case of the R phase transformation, on the other hand, it can be only utilized in a state of less than 1% of the distorsion and, accordingly, the generated load cannot be made larger than in the case of the martensite phase transformation, but there is an advantage that the repetition reliability is high. When the operating temperature is set to be higher than 60° C. in the R phase transformation, the phase transformation starting temperature in the martensite phase (Ms point) is necessarily made to be above −10° C., due to which the state of the phase is made different depending on the starting temperature at which the shape memory alloy is started to be heated, a rising temperature (As point) of the generated load is also made different, and eventually the operating temperature of the alloy is rendered to vary. Further, other types of the shape memory alloys showing phase transitions, but they are still unable to be usefully employed in the circuit breakers and protectors. That is, it is general that the current path protective devices are used in an environmental temperature range of −10° to 60° C. and are demanded to be operable constantly at a fixed temperature even when the detecting element of the device is started to be heated from any level of temperature within the range of −10° to 60° C., but there has been so far suggested no electric path protective device employing any shape memory alloy satisfying this demand.

TECHNICAL FIELD

A primary object of the present invention is, therefore, to overcome the foregoing problems and to provide a shape memory alloy and an electric path protective device employing the alloy which shows less fluctuation in the phase transformation temperature even through repetitive operation, as well as stable, reliable operation at a wide range of environmental temperature and further the ability to detect both overcurrent and short-circuit current.

According to the present invention, this object can be attained by a shape memory alloy consisting of a three-element alloy of 6–12 atomic % copper, 49–51 at. % titanium and the rest nickel, the alloy having been prepared as being subjected to a cold working rate of 10–40% and to a heat treatment at a temperature in a range of 350°–500° C. and below a recrystallization point of the alloy.

According to an electric path protective device employing the shape memory alloy of the present invention, the detecting element of the shape memory alloy and the magnetic member can be driven by both of the generated heat and magnetic field of the heater coil to which the electric current flowing through the electric path is made to flow, so that the device can be reliably responsive to both of the overcurrent and short-circuit current, with excellently stable operation, to improve the reliability and the environmental temperature can also be set in a range sufficiently satisfiable.

Other objects and advantages of the present invention shall be made clear in following description of the invention detailed with reference to certain embodiments shown, in accompanying drawings.

The present invention shall now be explained with reference to the embodiments shown in the accompanying drawings but, as will be readily appreciated, the present invention is not limited to such embodiments shown but is to rather include all modifications, alterations and equivalent arrangements possible within the scope of appended claims.

DISCLOSURE OF OPTIMUM EMBODIMENTS

Figure 1:
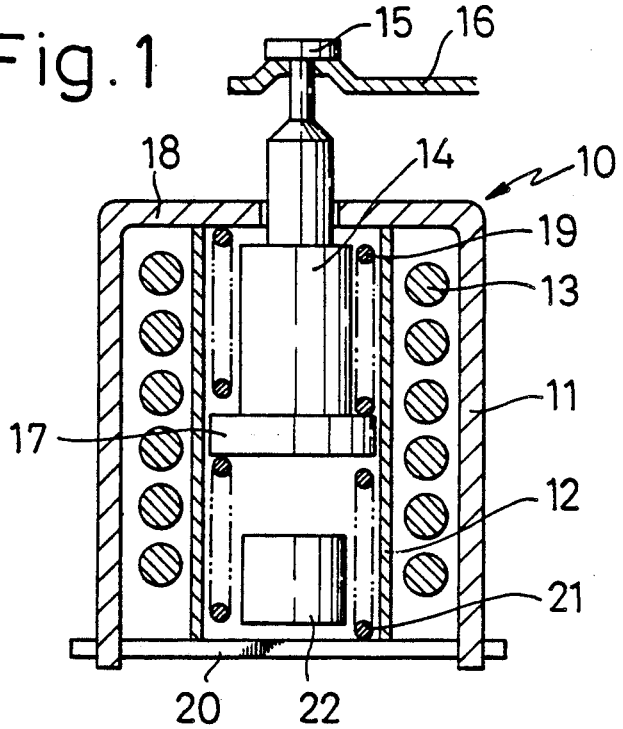
FIG. 1 is a schematic section showing the electric path protective device employing the shape memory alloy according to the present invention.

Referring to FIG. 1, there is shown an electric path protective device 10 employing a shape memory alloy according to the present invention, which generally comprises a yoke 11 of a magnetic material, a coil cylinder 12 disposed coaxially within the yoke 11, a heater coil 13 wound about the coil cylinder 12 still inside the yoke 11 and provided for flowing therethrough an electric current to be fed to an associated electric path (not shown) of the protective device 10, and a plunger 14 made of a magnetic material and disposed within the coil cylinder 12 for axial and vertical displacement, the plunger 14 being engaged at its upward projection 15 with a load lever 16 which is disposed to function, upon application of a predetermined load from the plunger 14, to actuate, for example, a latch mechanism (not shown) of any known circuit breaker for breaking the electric path.

The plunger 14 has a bottom path 17 made in the form of a flange of a relatively larger diameter, and a detecting element 19 of a shape memory alloy formed into a coil spring configuration is disposed in a space between the bottom part 17 and an inner wall at upper side part 18 of the yoke 11. Provided that the shape memory alloy forming the detecting element 19 is prepared as formed at a high temperature, the shape upon the forming is memorized by the alloy is to be restored even when the alloy is deformed at normal temperatures but as soon as the temperature is raised to the high temperature.

Further, between the bottom part 17 of the plunger 14 and lower side part 20 of the yoke 11, there is disposed a biasing spring 21 so that the detecting element 19 in the coil spring configuration will be biased by this spring 21 into a constant distorted state or, in other words, into a restrained state. In bottom part of the coil cylinder 12, that is, on opposing surface of the yoke's lower side part 20 to the plunger 14, there is disposed a fixed iron core 22.

When, in the electric path protective device 10 of the foregoing arrangement, an electric current which is, for example, 105 to 200% of rated current of the heater coil 13, that is, an overcurrent is kept flowing through the coil, the heat is generated at the coil and the detecting element 19 is thereby heated. As the temperature of the element 19 is thus raised and exceeds a phase transformation starting temperature (As point) of the alloy, the detecting element 19 is apt to deform quickly to restore its stored shape in a direction of displacing the plunger 14 downward, upon which, however, the element 19 kept in the restrained state by the biasing force of the spring 21 still does not cause the plunger 14 to be displaced. As the load produced by the element 19 develops to be larger than a sum of the loads of the load lever 16 and biasing spring 21, the latch mechanism of the circuit breaker to which the lever 16 is coupled is tripped to break the circuit in known manner. When a short-circuit current is caused to flow through the heater coil 13, an electromagnetic attraction thereby generated at the coil attracts the plunger 14 downward to the fixed iron core 22, and the load lever 16 is thereby actuated to trip the latch mechanism, for example, for breaking the circuit.

The present inventors have thoroughly investigated the shape memory alloy forming such detecting element 19 as in the above, and have devoted themselves to realization of an alloy which can satisfy following three characteristics concurrently:

(a) The alloy should show less fatigue and only a slight fluctuation in the phase transformation (or critical) temperature before and after repetitive operation carried out, and should be clearly improved in the reliability. It is considered that the fatigue can be made less in response to a reduction of such temperature fluctuation to be less than 10 degrees, in contrast to the case of known martensite phase transformation showing a large hysteresis as to be about 30° C.

(b) The operation temperature should be able to be set higher than 60° C. The phase transformation temperature can set the operation temperature by optimumly setting conditions determined by the composition or heat treating temperature of the shape memory alloy.

(c) An actuation in a temperature range of −10° C. to 60° C. should be assurable reliably. In the case of the nickel-titanium-copper series alloy, the phase transformation starting temperature of the martensite phase is below −10° C. even when the heating is initiated at any optional temperature in the range of −10° C. to 60° C., so that the phase transformation starting temperature, that is, As point of the alloy is to be made constant.

Other than the nickel-titanium-copper series alloy, it may be also possible to enumerate nickel-titanium-paradium series alloys as the shape memory alloy satisfying the foregoing three characteristics (a) to (c). Because of such expensive component as paradium, however, the nickel-titanium-copper series alloy is more practically advantageously utilized in view of costs. For the nickel-titanium-copper series alloy, there can be included such three component alloys as the nickel-titanium-copper alloys, and four component alloys containing such fourth element as niobium, boron or the like added to the nickel-titanium-copper composition. When the alloy is employed in the electric path protective device, it is particularly preferable to adopt a shape memory alloy containing copper of 6–12 atomic %, titanium of 49–51 at. % and the rest being nickel. Here, provided that copper content is less than 6 at. %, an optimum phase transformation cannot be achieved but, when it is more than 12 at. %, the alloy is deteriorated in the workability so as to be hard to be drawn into wire shape. When titanium is not more than 49 at. % or more than 51 at. %, the composition range becomes out of that for the intermetallic compound and the shape memory phenomenon disappears.

In order to reduce any deterioration due to the repetitive operation and thus to improve the reliability of the alloy, on the other hand, it is effective to carry out a cold working with respect to material alloy wire and then a heat treatment at a temperature below recrystallization temperature for the shape memory. This means that the alloy is to be used in a state where any working distortion remains in the alloy, so as to cause it contributive to the reliability improvement. Here, the heat treatment should preferably be at a temperature in a range of 350°–500° C., since the treatment below 350° C. results in insufficient shape memory while the treatment above 500° C. causes the recrystallization temperature to be exceeded to render the deterioration after the repetitive operation rather remarkable. The cold working rate of 10–40% as denoted by area reduction rate in sectional area before and after the working should be proper, since a rate of less than 10% shows no improvement in the deteriorated characteristics while that more than 40% renders the wire drawing difficult.

Now, the more optimum composition, heat treatment temperature and cold working rate should be, for the composition, copper of 9.0±1 at. %, titanium of 49.4–50.5 at. % and nickel of the rest; for the heat treatment temperature, 450°±20° C.; and, for the cold working rate, 15–30%. In order to elevate the phase transformation temperature, it is preferable that the heat treatment is carried out at a higher temperature, while a lower heat treatment temperature is preferable for the deterioration reduction, so that the proper heat treatment temperature will be 450°±20° C. Provided that the temperature exceeds 470° C., the shape memory alloy shows a remarkable deterioration in the output after the repetitive operation, but the temperature below 430° C. results in a lower phase transformation temperature. When the heat treatment temperature is 450°±20° C. and the alloy composition is made to be of copper 8+1 at. % and titanium 49.4–50.5 at. % with nickel the rest, the phase transformation temperature is raised to be more preferable. The cold working rate should optimumly be 15–30%, since two stage transformations at 0% working are made one stage transformation at 15% and more to remarkably improve the deterioration whereas the working rate more than 30% renders the work hardening increased so that the working with respect to the material alloy wire becomes extremely complicated.

In the present invention, on the other hand, the detecting element of the shape memory alloy is employed as preliminarily provided with a stress, so that the operating temperature can be raised. More specifically, the phase transformation temperatures under varying stresses in three-element alloy phase transformation of the nickel-titanium-copper alloy have been measured, and it has been found that the stress keeping ability is made so larger as to be 0.06° C./MPa, which is two times as large as that of a nickel-titanium alloy. Accordingly, the operation temperature can be raised remarkably by the combined use of the detecting element with the biasing spring 21, and a proper selection of the spring load of the biasing spring 21 allows the operation temperature to be effectively controllable. Further, it is optimum that the spring shearing stress provided to the shape memory alloy is made to be in a range of 20–250 MPa, since the stress not more than 20 MPa renders the operation temperature to be below 60° C. and the operation is made to be at a temperature in a range of operation assurance of the device 10 improperly whereas the stress above 250 MPa causes the stress-distortion characteristics at a higher temperature phase to be not proportional so as to have the precision of spring designing deteriorated. Further, the spring shearing stress should preferably be below 1.2%, since it has been confirmed that, as the stress exceeds 1.2%, the deterioration becomes larger and the repetitive operation ability is lowered.

In the foregoing U.S. patent of Melton et al, on the other hand, the alloy therein disclosed is of a composition, as converted into the atomic %, 0.4–26.0 at. % copper, 45.1–51.6 at. % titanium and 21.7–50.6% at. % nickel, and the three-element alloy of the present invention may appear to be within this known composition. In the present invention, however, it should be appreciated that the composition of the respective metal components is defined to be within a narrower range and the alloy of the present invention is prepared through the cold working and the heat treatment at a temperature below the recrystallization point for memorizing the shape, so that the thus realized alloy is an entirely new three-element alloy showing the minimum fluctuation in the phase transformation temperature after the repetitive operation, still high stabilization in the operation and remarkably expanded environmental temperature in which the alloy can be employed.

EXAMPLE

Figure 2:
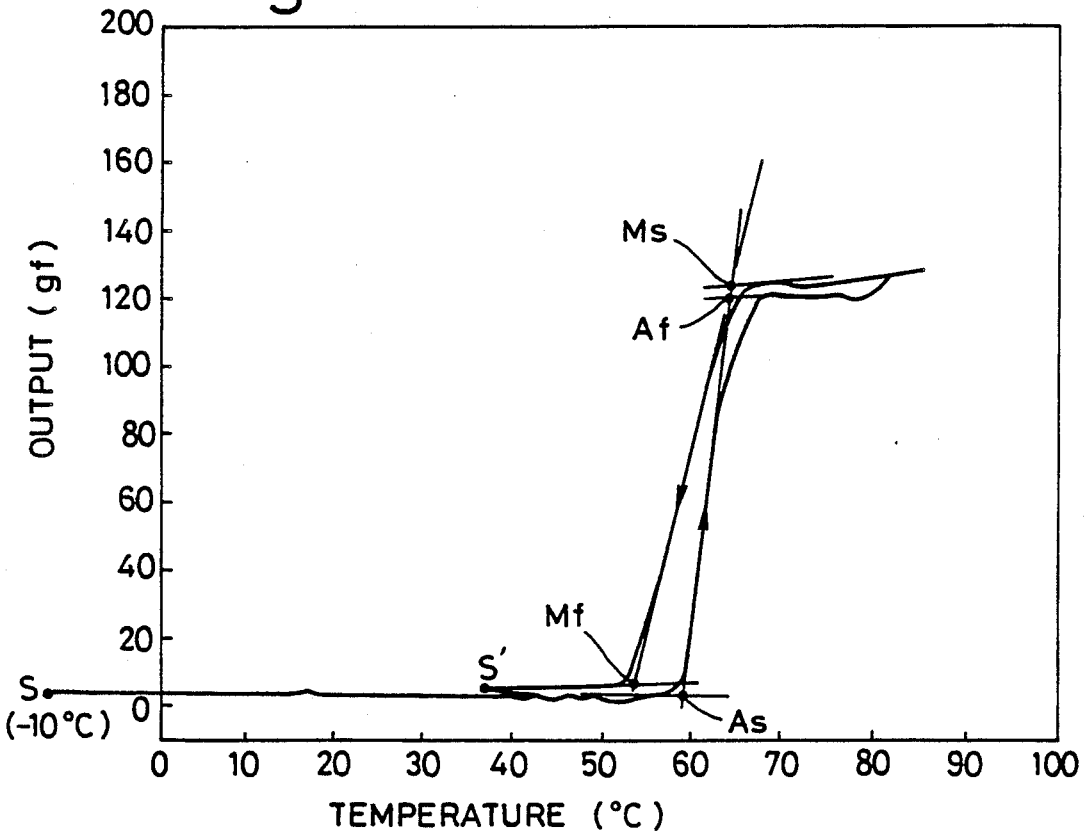
FIG. 2 is a diagram showing temperature-to-output load characteristics of the shape memory alloy in a working aspect of the present invention.

An alloy wire of the three element composition of nickel-titanium-copper series was wound on a jig and formed into a coil spring, which was then subjected to a heat treatment in a restrained state. The thus obtained coil spring of the shape memory alloy was restrained further to reach a predetermined stress and was subjected to the measurement of the temperature-load characteristics under a variety of temperature. FIG. 2 represents the temperature-to-output load characteristics in the event where the three element alloy is of copper 9.2 at. %, titanium 49.4 at % and the rest being nickel, with the heat treating temperature of 500° C. and the cold working rate of 27%. In the drawing, As and Af points denote the phase transformation starting and finishing temperatures, respectively, toward the higher temperature phase, and Ms and Mf points denote the phase transformation starting and finishing temperatures, respectively, toward the lower temperature phase.

Figure 3:
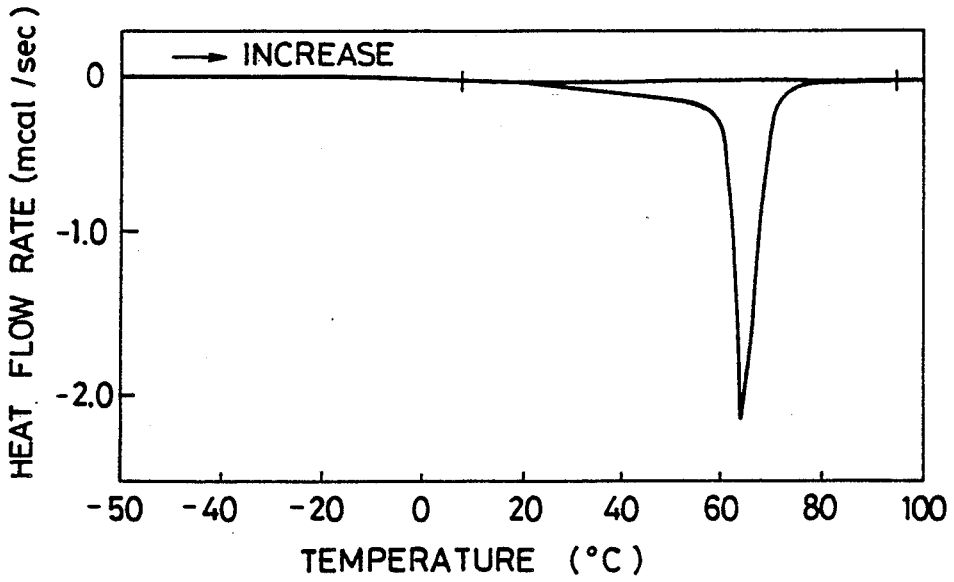
FIG. 3 is a diagram showing measurement of endotherm by means of DSC upon temperature raising for the alloy of FIG. 2.
Figure 4:
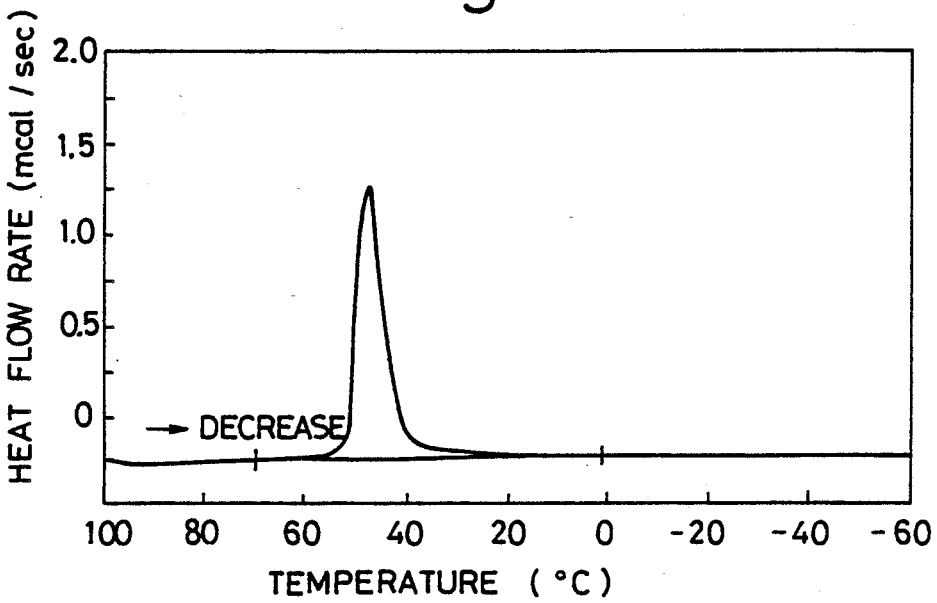
FIG. 4 is a diagram showing measurement of calorific value by means of DSC for the alloy of FIG. 2.

As would be clear from FIG. 2, the phase transformation starting temperature (As point) corresponding to the rising temperature of the generated load has been about 60° C. to be substantially constant even when the heating was started either from the lowest temperature −10° C. (S point) or from another temperature 36° C. (S′ point) within the range of the environmental temperature in which the actuation has been assured. Results of the measurement with respect to the present alloy through DSC method are shown in FIG. 3 for the case of raising the temperature, and in FIG. 4 for the case of lowering the temperature. As would be clear from these drawings, only a single peak has appeared commonly in both of the heating and cooling in a range of −50° C. to 100° C. to represent that the phase transformation mode was single in this temperature range, and thus the phase transformation mode also has become constant. The phase transformation starting temperature thus made constant means that the device can be used even when the temperature is lowered to −50° C., and the environmental temperature range in which the actuation is assured can be so widened as to be at least −10° C. to 60° C.

Figure 5:
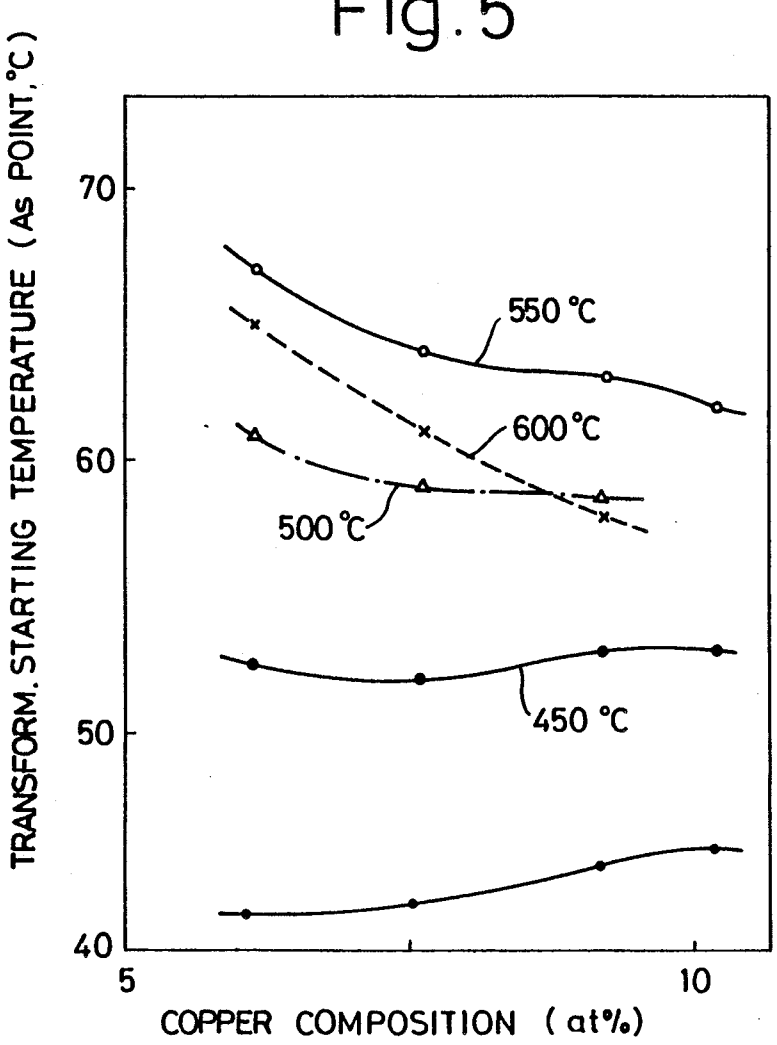
FIG. 5 is a diagram showing measurements of the phase transformation starting temperature for various shape memory alloys employable in the present invention.

Further results of the measurement of the phase transformation starting temperature (As point) carried out with respect to the nickel-titanium-copper alloys of various compositions with the heat treating temperature varied are as shown in FIG. 5. The cold working rate was set to be 27% during the measurement and maintained to be constant. In consequence thereof, it has been found that the phase transformation starting temperature has been raised as the heat treating temperature was raised up to 550° C. In a following Table I, a hysteresis for the heat treating temperature of 500° C. is shown, the hysteresis being of a temperature width between the cases of the temperature raising and lowering, and a calculation has been made by means of a formula $(As+Af-Ms-Mf)/2$.

TABLE I

| Composition (Ti = 49.4 to 50.0 at. %) | Hysteresis (deg) |
|---|---|
| Cu 6.1 at. %-Ti—Ni | 8.0 |
| Cu 7.6 at. %-Ti—Ni | 4.5 |
| Cu 9.2 at. %-Ti—Ni | 3.0 |
| Cu 10.2 at. %-Ti—Ni | 0 |

From the above Table I, it has been found that the hysteresis decreases as the copper content becomes higher, and that all of these alloys of varying compositions have satisfied a hysteresis of below 10 deg., satisfying thus the required characteristics for the circuit breakers.

Figure 6:
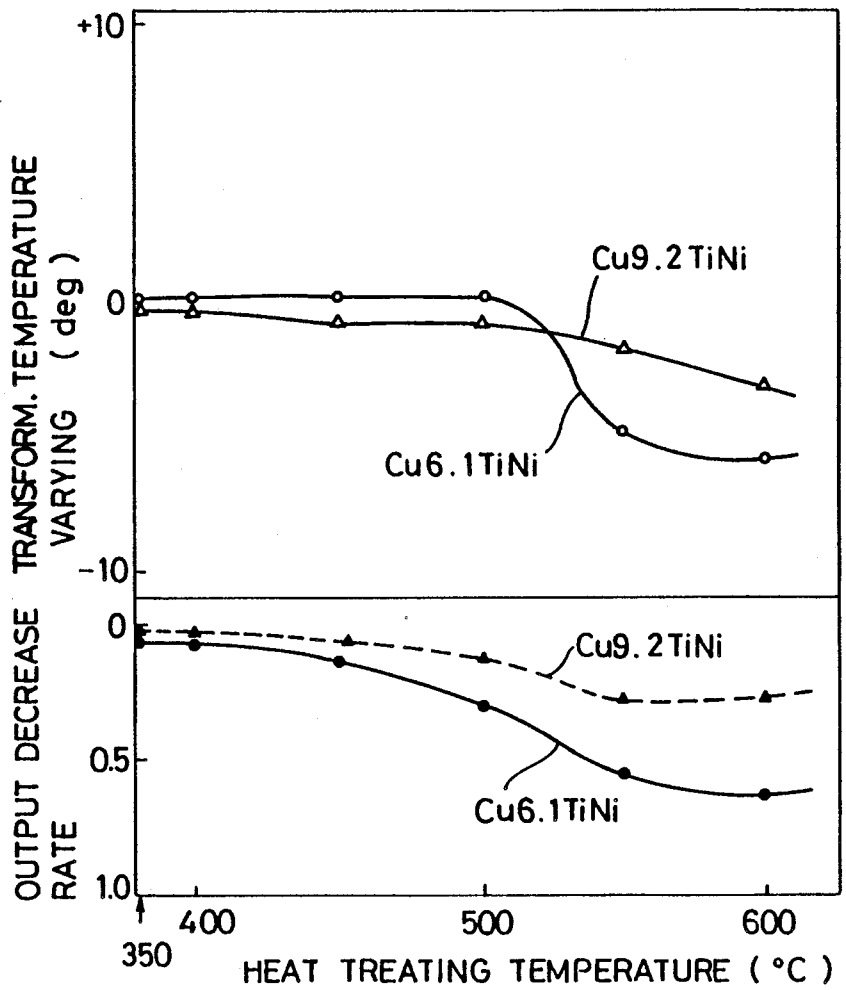
FIG. 6 is a diagram showing concurrently the relationship of heat treating temperature for the alloy of the present invention to the variation in phase transformation temperature and to the output decrease rate.

Next, a heat cycle test was carried out with respect to the reliability of the repetitive operation, between two temperatures on both sides of the phase transformation temperature, and results of measurement of varying phase transformation temperature (As point) and output decrease rate before and after the test were as shown in FIG. 6. The heat cycle test was carried out between the two temperatures T1=85° C. (30 min.) and T2=0° C. (30 min.) with the alloy coil spring restrained at a constant distortion, and repeating the temperature raising and lowering for 1,000 times. For the shape memory alloy, nickel-titanium-copper alloys each containing copper of 6.1 at. % and 9.2 at.% were employed, the cold working rate of which was made 27%, and the heat treatment was carried out at various temperatures. In FIG. 6, curves of white and black circle dots denote the variation in the phase transformation temperature and the output decrease rate, respectively, of the alloy of 6.1 at. % copper, and curves of white and black triangle dots denote the variation in the phase transformation temperature and the output decrease rate, respectively, of the other alloy of 9.2 at. % copper. In these instances, titanium content was 49.4 to 50.0 at. %, and the shearing stress under the restraint was 0.55%.

Next, the heat treating temperature was set to be in a range of 350°–500° C., whereby the variation width of the phase transformation starting temperature has become less than 1 deg. as would be seen in FIG. 6, and the output decrease rate could be restricted to be less than 30% at the largest. It has been found here that, since the recrystallization is initiated inside the alloy when the heat treating temperature exceeds 500° C. to render the deterioration due to the repetitive operation to be remarkable, the treating temperature is required to be in the range of 350°–500° C. from the viewpoint of the deterioration prevention, and the treating temperature of 450±20° C. should properly be adopted, taking also into consideration the phase transformation temperature being made higher.

Figure 7:
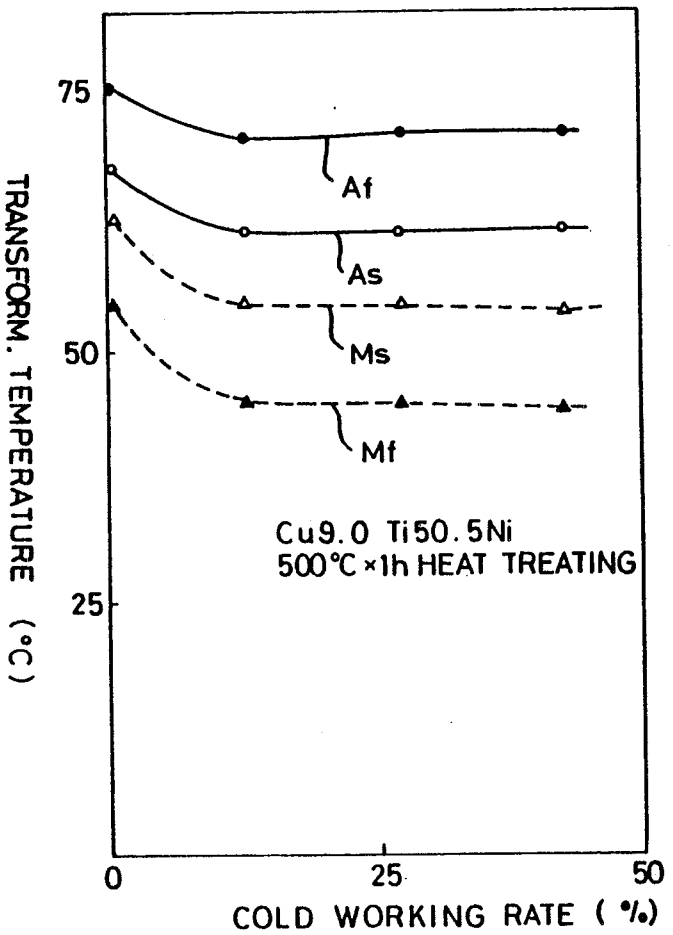
FIG. 7 is a diagram showing the relationship between the cold working for the alloy of the present invention to the phase transformation temperature.

Further, results of measurement through the DSC method of the phase transformation temperature with the cold working rate variously changed were as shown in FIG. 7. The shape memory alloy was of a composition of 9.0 at. % copper, 50.5 at. % titanium and the rest nickel, which was heat-treated at 500° C. for 1 hour. It has been found that the cold working carried out at a rate of more than 10% has rendered the phase transformation temperature constant. In order to attain an effect of preventing the deterioration due to the remaining working strain, the working rate of at least more than 10% that renders the phase transformation temperature constant, or more optimumly more than 15% has been found to be necessary.

Figure 8:
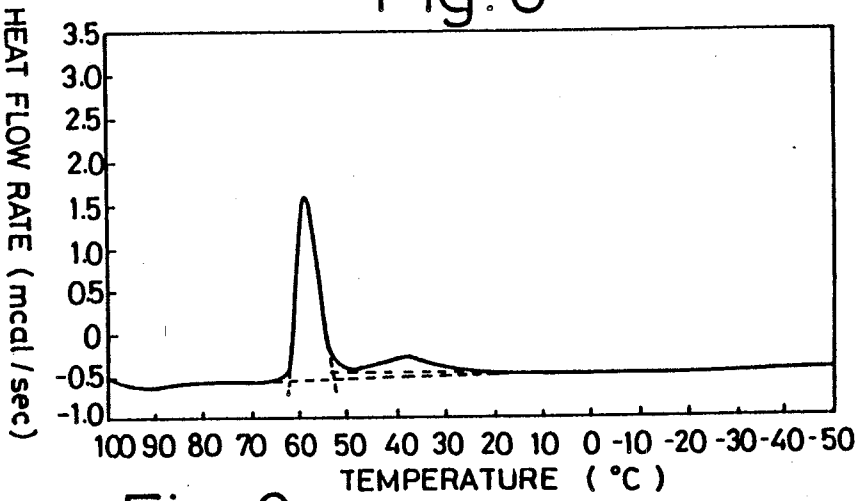
FIGS. 8, 10 and 12 are diagrams showing respectively measurement of the endotherm by means of DSC upon lowering the temperature with a variety of the cold working rate with respect to the shape memory alloy.
Figure 9:
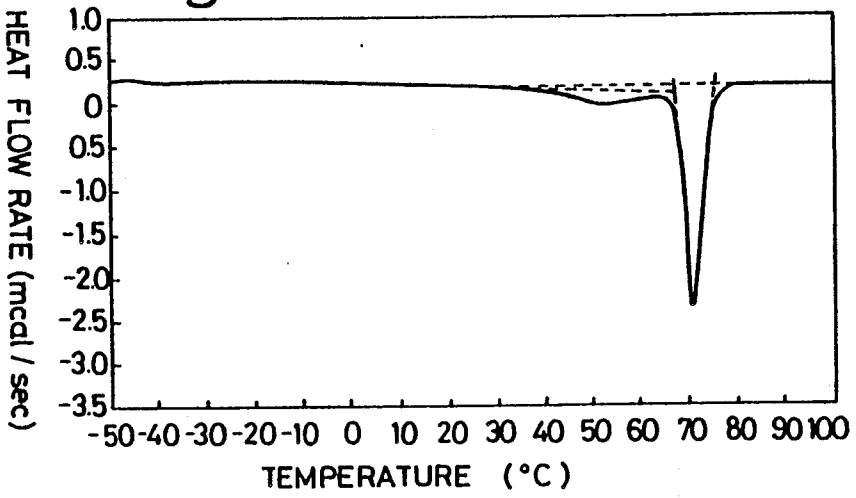
FIGS. 9, 11 and 13 are diagrams showing respectively measurement of the calorific value by means of DSC upon raising the temperature with a variety of the cold working rate with respect to the shape memory alloy.
Figure 10:
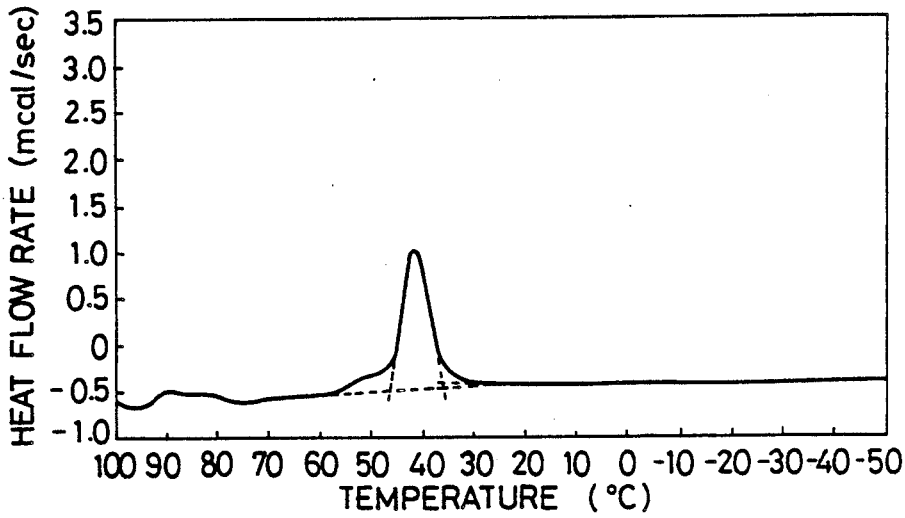
Figure 11:
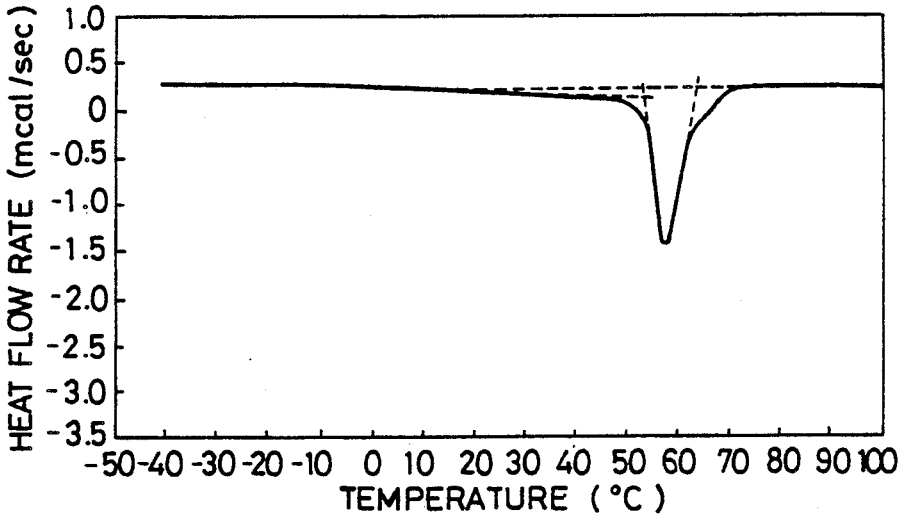
Figure 12:
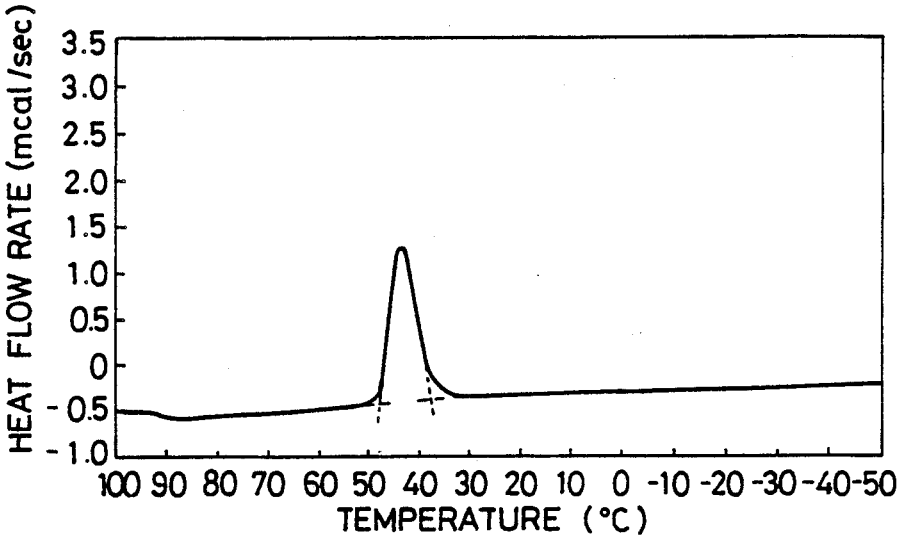
Figure 13:
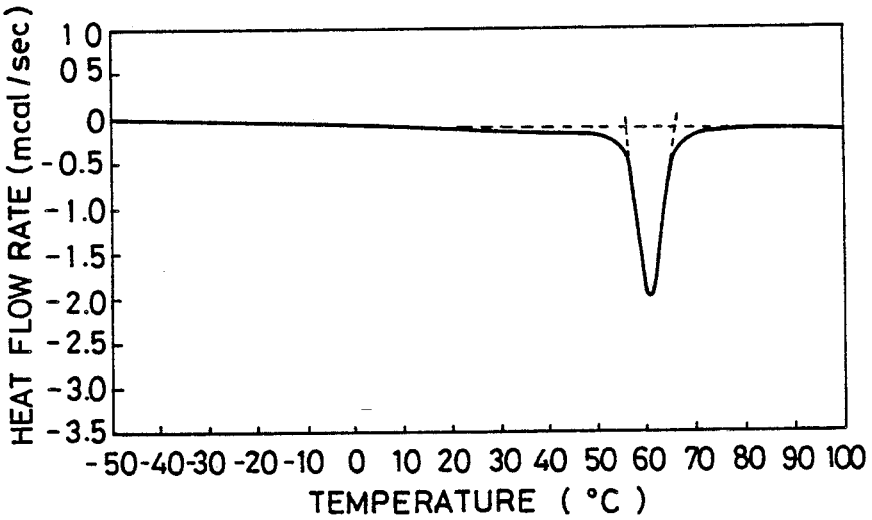

The DSC characteristics of the alloy of the foregoing composition subjected to the heat treatment at 450° C. for 1 hour with the working rate variously changed were as shown in FIGS. 8, 10 and 12 for those upon the temperature lowering and in FIGS. 9, 11 and 13 for these upon the temperature raising. Here, it has been found that two peaks of heat absorption and heat generation appear when the working rate is 0% as in FIGS. 8 and 9, that the second stage peak becomes not clear when the working rate is 15% as in FIGS. 10 and 11, and that the second stage peak is eliminated when the working rate is made to be 27% as in FIGS. 12 and 13.

Figure 14:
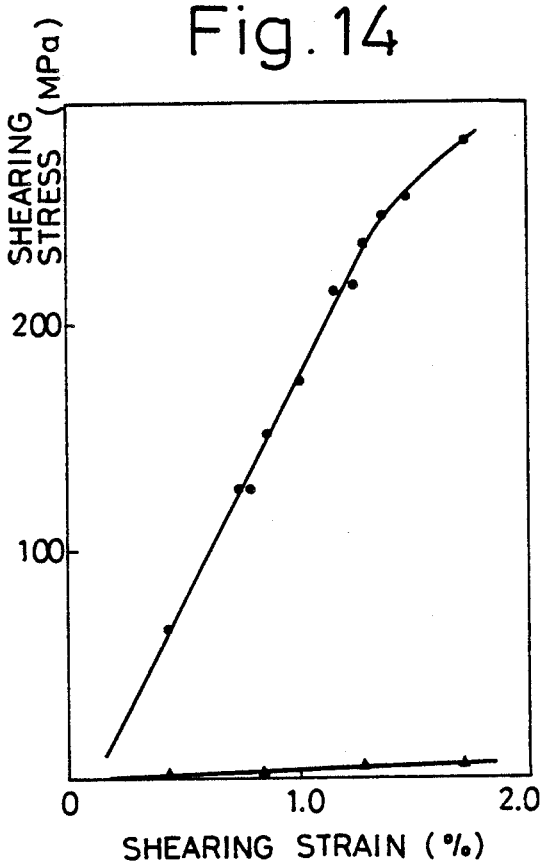
FIG. 14 is a diagram showing the relationship between shearing stress and shearing strain at higher and lower temperature phases of the shape memory alloy.
Figure 15:
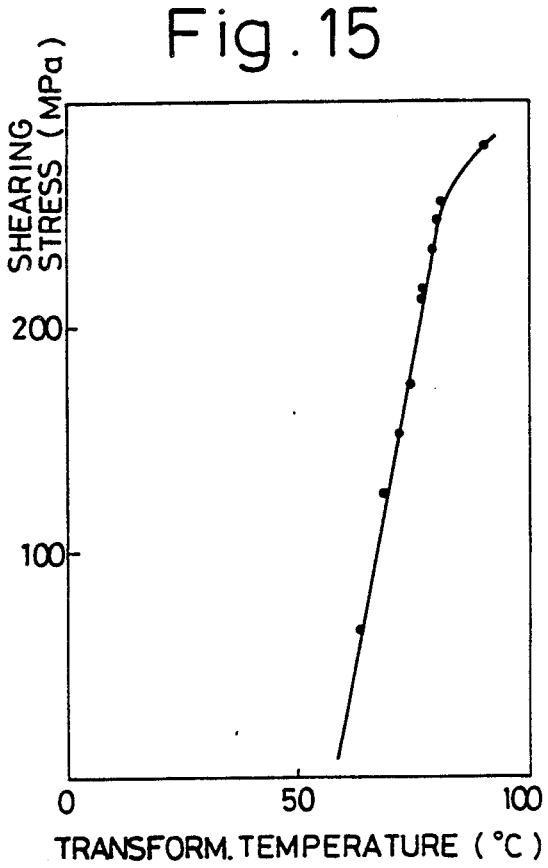
FIG. 15 is a diagram showing the relationship between the phase transformation temperature and the shearing stress of the shape memory alloy.

Next, the relationship between the shearing stress-shearing strain-phase transformation temperature was measured with the strain amount variously changed, and results of this measurement were as shown in FIGS. 14 and 15. The shape memory alloy employed here was of a composition of 9.0 at. % copper, 50.5 at. % titanium and the rest nickel, while the heat treating temperature was made at 450° C. and the cold working rate as made 27%. In FIG. 14, a curve of black circle dots denotes the measurement for the higher temperature phase while another curve of black triangle dots denotes that for the lower temperature phase, and it will be appreciated that, as will be clear from FIGS. 14 and 15, the stress-strain relationship for the higher temperature phase is in proportional relationship up to the stress of 250 MPa and the strain of 1.4% and is in accordance with the Hooke's law. Further, it has been also found that, as the load stress rises, the phase transformation temperature also rises. Consequently, it has been found that the spring shearing stress to be provided to the shape memory alloy should properly be in a range from about 20 MPa the actuating temperature at which exceeds 60° C. to about 250 MPa which is the limit of the proportional stress-strain relationship.

While in the present invention the shape memory alloy as the detecting element 19 is provided with the spring load of the biasing spring 21 for controlling the actuating temperature of the element, on the other hand, such control has been found to be effective in a range of about 60°-80° C. in view of the characteristics shown in FIG. 15. Further, as has been found from empirical data, the particular Ni-Ti-Cu alloy has such another feature that the alloy becomes extremely low in the strength in the low temperature phase as will be clear in particular from FIG. 14 (about 1/10 at the strain of 0.8% in contrast to Ni-Ti alloy). Here, in the shape memory alloy as the detecting element 19, an output difference between the higher and lower temperatures can be effectively utilized, so as to be able to obtain a larger output and to be extremely advantageous.

Figure 16:
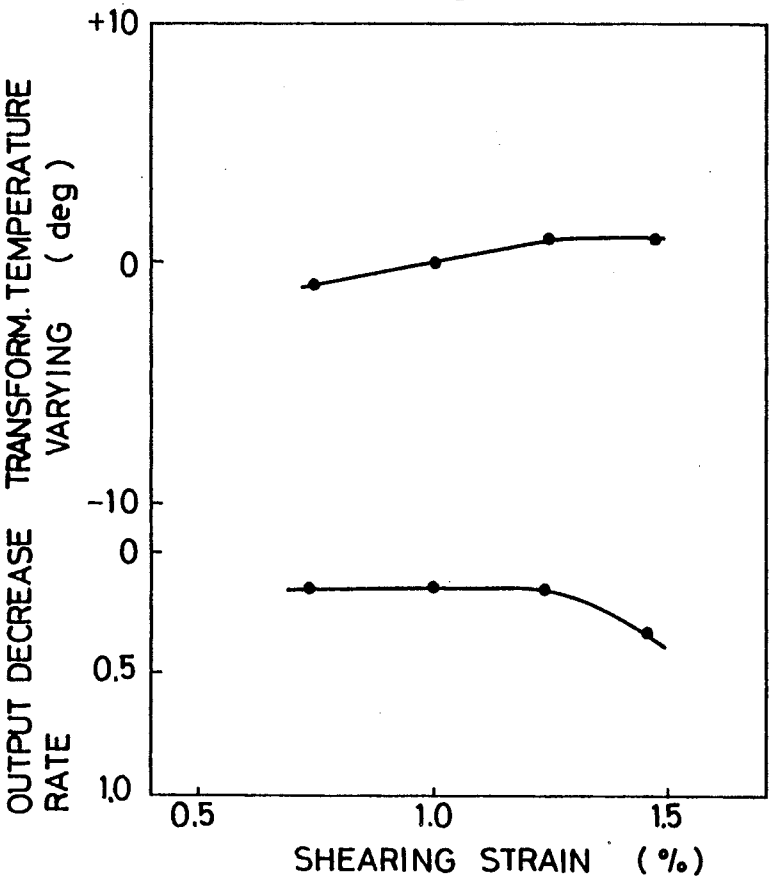
FIG. 16 is a diagram showing concurrently the relationship of the shearing strain of the alloy to the variation in phase transformation temperature for the alloy and to the output decrease rate.

Next, the shape memory alloy was subjected to the restraint under variously changed shearing strain and to the heat cycle test, and any variation in the phase transformation temperature after the test and the output decrease rate were measured, results of which were as shown in FIG. 16. For the heat cycle test, the temperature raising and lowering were repeated for 1,000 times between the temperatures T1 = 100° C. and T2 = −20° C. The alloy composition and heat treating temperature were made the same as those for the measurement of FIGS. 14 and 15. Here, it has been found that the alloy should preferably be employed at a strain less than 1.2% since the output decrease was likely to increase as the strain exceeded about 1.2%, and that the strain less than 1.2% was effective to attain the output decrease of about 15% and the phase transformation temperature variation of +1 deg, and thus to keep the reliability of the device high.

Figure 17:
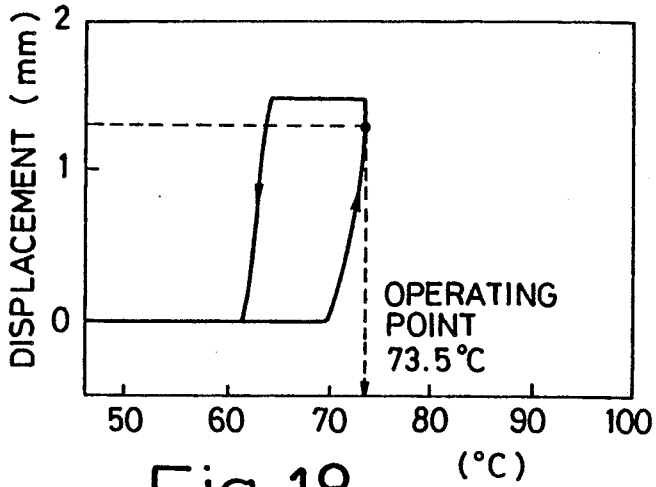
FIG. 17 is a diagram showing the relationship between initial temperature of heat cycle and displacement in a combined state of the shape memory alloy with a biasing spring.
Figure 18:
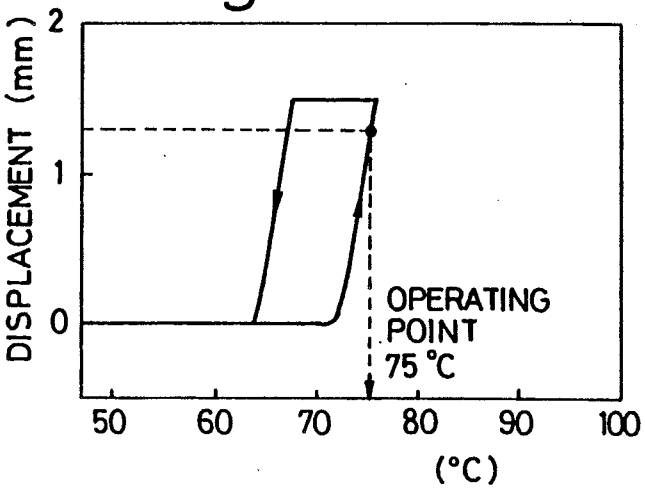
FIG. 18 is a diagram showing the relationship between the temperature after the heat cycle and the displacement in the same state as in FIG. 17.

Finally, the detecting element 19 of the shape memory alloy according to the present invention was incorporated into the electric path protective device 10 of FIG. 1, and the device as subject to an operating test under the conditions of the load of 50 g for the load lever 16 and the generated load of 100 g for the biasing spring 21. That is, the detecting element 19 was employed in combination with the biasing spring 21, the heat cycle test was carried out in a state of applying a load, and the temperature-displacement characteristics before and after the test were as shown in FIGS. 17 and 18. The detecting element 19 was made to have an entire diameter of the coil of 6 mm, coil wire diameter of 0.6 mm, winding number of 8.3 turns and a free released height of 21.9 mm. The alloy composition, heat treating temperature and cold working rate were made the same as those for the measurement of FIGS. 14 and 15, while the shearing strain of the alloy upon its displacement for about 1.3 mm upon the actuation, that is, for tripping the latch mechanism. For the heat cycle test, the temperature raising and lowering between T1 = 100° C. and T2 = −20° C. were repeated for 1,000 times. Here, FIG. 17 is for the characteristics at initial stage of the heat cycle and FIG. 18 is for those immediately after the test, in view of which it has been found that the operating temperature upon the initial operation, that is, upon the displacement of 1.3 mm was 73.5° C. and the temperature immediately after the heat cycle was 75° C., showing that there was no substantial change in the repeated operating temperature, as remained to be in an extent of 1.5 deg to render the device to be highly reliable. When the operating temperature was above 70° C. and was lowered to 60° C., the initial state of displacement 0 has been restored, and the operating temperature and assured temperature range would be able to be set at desired values.

COMPARATIVE EXAMPLE 1

Figure 19:
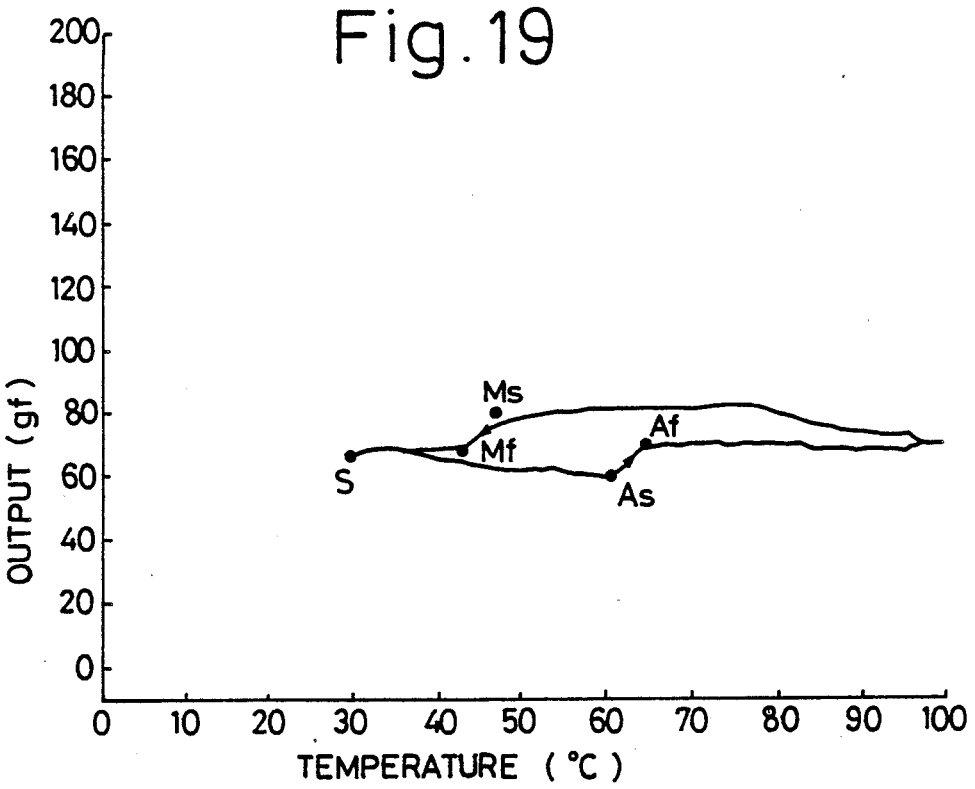
FIG. 19 is a diagram showing temperature-load characteristics of an alloy according to Comparative Example 1.

An alloy wire of two element composition of nickel-titanium series was used to prepare a detecting element of the R phase transformation in the same manner as in the foregoing Example, and its temperature-load characteristics were measured, results of which were as shown in FIG. 19. When the heating of this alloy was started and raised from a temperature of 6° C. (S point), the phase transformation starting temperature (As point) was about 70° C., whereas the phase transformation starting temperature (As point) was changed to about 60° C. when the heating was started and raised from another temperature of 44° C. (S' point). It has been found, therefore, that the different heat starting temperatures even within the temperature range in which the device operation should be assured (−10° to 60° C.) result in a remarkable difference in rising points of the generated load and thus the element can hardly be adapted to the electric path protective device.

COMPARATIVE EXAMPLE 3

Figure 20:
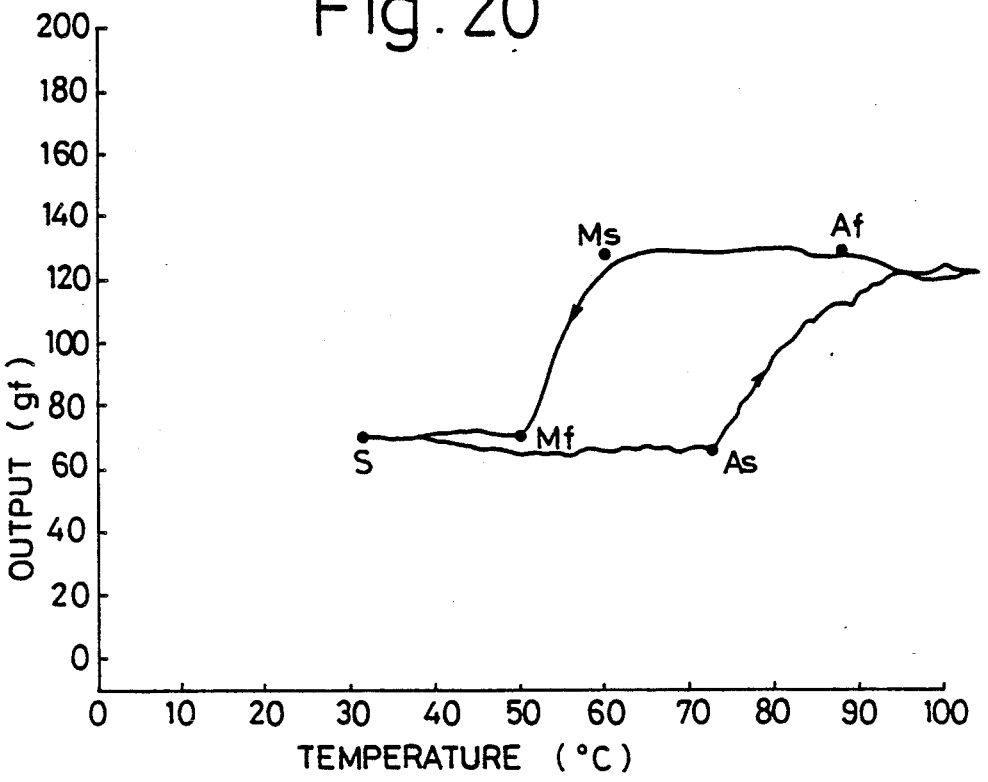
FIG. 20 is a diagram showing temperature-load characteristics of an alloy according to Comparative Example 2 prior to a heat cycle test.
Figure 21:
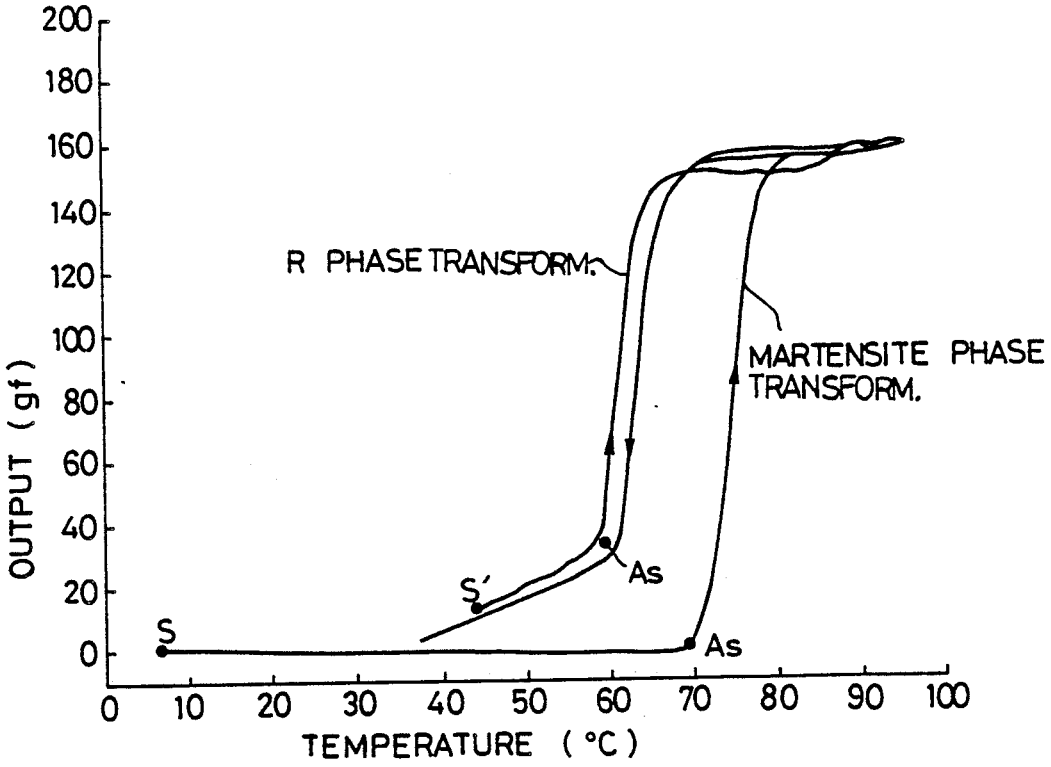
FIG. 21 is a diagram showing temperature-load characteristics of the alloy according to Comparative Example 2 after the heat cycle test.

An alloy wire of two element composition of nickel-titanium series was employed to prepare a detecting element of the martensite phase transformation in the same manner as in the foregoing Example, and its temperature-load characteristics were measured. The characteristics measured before the heat cycle test were as shown in FIG. 20 while those measured after the test were as in FIG. 21, a comparison of which should reveal that, after the heat cycle test, the phase transformation starting temperature (As point) was lowered by 13° C. and the generated load was also remarkably decreased in contrast to that of the element according to the present invention, whereby it has been found that the alloy of the martensite phase transformation could hardly be applied to the electric path protective device.

COMPARATIVE EXAMPLE 3

A detecting element was prepared with a shape memory alloy of copper-aluminum series, the element was restrained at a constant strain, the heat cycle test was carried out with respect to such element and the variation in the phase transformation temperature was measured. The heat cycle was made between T1=150° C. and T2=10° C., the range including both sides of the phase transformation temperature, and the temperature raising and lowering were repeated for 300 times, results of which measurement were as shown in following Table II.

TABLE II

| Strain (as restricted) | Phase Trans. Temp. Initial | Phase Trans. Temp. After Test | Variation Width (deg) |
|---|---|---|---|
| 0.9% | 105 | 115 | 10 |
| 1.7% | 105 | 116 | 11 |

As would be clear from the above Table II, it has been found that the phase transformation temperature after the heat cycles of 300 times was made higher by 10° to 11° C., and the element was poor in the reliability with respect to the repetitive operation and could hardly be utilized for the electric path protective device.

While in the foregoing description the shape memory alloy of the present invention has been referred to only with reference to the embodiments in which the alloy is employed in the electric path protective device, it should be appreciated that the use of the alloy of the present invention is not limited to them but may equally be expanded to such other devices as an actuator acting also as a sensor, and so on.

What is claimed is:

1. A shape memory alloy comprising essentially of 6–12 at. % copper, 49–51 at. % titanium and nickel, said alloy having been cold worked at a rate of 10–14% and heat treated at a temperature within a range of 350°–500° C. and below a recrystallization point of the alloy, for memorizing the shape.

2. An alloy according to claim 1 wherein said alloy has been heat treated in a state where a working strain is left in the interior of the alloy.

3. An alloy according to claim 2 wherein said alloy comprises 9.0±1 at. % copper, 49.4–50.5 at. % titanium and nickel, said cold working rate is 15–30%, and said alloy is heat treated at 450°±20° C.

4. An alloy according to claim 3 wherein said alloy is provided with a shearing stress of 20–250 MPa.

5. An alloy according to claim 3 wherein said alloy is provided with a spring shearing strain of less than 1.2%.

6. A method for manufacturing a shape memory alloy, the method comprising the steps of preparing an alloy of 6–12 at. % copper, 49–51 at. % titanium and nickel, cold working the alloy at a rate of 10–40%, and further heat treating the alloy at a temperature within a range of 350°–500° C. and below a recrystallization point of the alloy for storing the shape.

7. A circuit protective device consisting essentially of a heater coil connected to receive an electric current which flows through an associated electric path, a detecting element of a shape memory alloy the shape of which is changed by heat generated by said heater coil upon overcurrent flow through the electric path, an associated breaking means for breaking current flow through the electric path actuated responsive to the change of shape of said shape memory alloy upon overcurrent flow, and a magnetic member disposed to be driven by a magnetic field generated by said heater coil for actuating said electric path breaking means upon flowing of a short-circuit current through the heater coil, said shape memory alloy of said detecting element being made of an alloy comprising 6–12 at. % copper, 49–51 at. % titanium and nickel, said alloy having been cold worked at a rate of 10–40% and heat treated at a temperature in a range of 350°–500° C. and below a recrystallization point of the alloy for storing the shape.

8. A device according to claim 7 wherein said shape memory alloy is heat treated in a state where a working strain is left in the interior of the alloy.

9. A device according to claim 7 wherein said shape memory alloy comprises 9.0±1 at. % copper, 49.4–50.5 at. % titanium and nickel, and said alloy is said cold worked at a rate of 15–30% and heat treated at 450°±20° C.

10. A device according to claim 9 wherein said alloy is provided with a shearing stress of 20–250 MPa.

11. A device according to claim 9 wherein said alloy is provided with a spring shearing strain of less than 1.2%.

12. A shape memory alloy consisting essentially of 6–12 at. % copper, 49–51 at. % titanium, substantially all of the remainder being nickel and also including one of niobium and boron, said alloy having been cold worked at a rate of 10–40% and heat treated at a temperature within a range of 350°–500° and below a recrystallization point of the alloy, for memorizing the shape.

13. A circuit protective device comprising a heater coil connected to receive an electric current which flows through an associated electric path, a detecting element of a shape memory alloy the shape of which is changed by heat generated by said heater coil upon overcurrent flow through the electric path, an associated breaking means for breaking current flow through the electric path actuated responsive to the change of shape of said shape memory alloy upon overcurrent flow, and a magnetic member disposed to be driven by a magnetic field generated by said heater coil for actuating said electric path breaking means upon flowing of a short-circuit current through the heater coil, said shape memory alloy of said detecting element being made of a three element alloy consisting of 6–12 at. % copper 49–51% titanium and nickel, said alloy being subjected to a cold working rate of 10–40% and heat treated at a temperature in a range of 350°–500° C. and below a recrystallization point of the alloy for storing the shape.

* * * * *

PRINTER'S TRIM LINE

UNITED STATES PATENT AND TRADEMARK OFFICE

CERTIFICATE OF CORRECTION

PATENT NO. : 5,001,446

DATED : March 19, 1991

INVENTOR(S) : Tsuji et al.

It is certified that error appears in the above-identified patent and that said Letters Patent is hereby corrected as shown below:

Column 11, line 58, change "comprising" to --consisting--;

line 60, change "10-14" to --10-40--.

Signed and Sealed this

Fifteenth Day of September, 1992

*Attest:*

DOUGLAS B. COMER

*Attesting Officer*

*Acting Commissioner of Patents and Trademarks*